US006751436B2

(12) United States Patent
Bhatti et al.

(10) Patent No.: US 6,751,436 B2
(45) Date of Patent: Jun. 15, 2004

(54) APPARATUS AND METHOD FOR LAMINATING A PRINT MEDIUM IN A PRINTING DEVICE

(75) Inventors: Kris Bhatti, Boise, ID (US); Lynda Fengler, Meridian, ID (US)

(73) Assignee: Hewlett-Packard Development Company, L.P., Fort Collins, CO (US)

( * ) Notice: Subject to any disclaimer, the term of this patent is extended or adjusted under 35 U.S.C. 154(b) by 0 days.

(21) Appl. No.: 10/280,588

(22) Filed: Oct. 24, 2002

(65) Prior Publication Data

US 2004/0081494 A1 Apr. 29, 2004

(51) Int. Cl.[7] ..... G03G 15/20
(52) U.S. Cl. ..... 399/341; 399/342
(58) Field of Search ..... 399/341, 342

(56) References Cited

U.S. PATENT DOCUMENTS

| | | | | |
|---|---|---|---|---|
| 5,260,753 A | * | 11/1993 | Haneda et al. | 399/341 X |
| 5,339,148 A | * | 8/1994 | Johnson et al. | 399/341 |
| 5,751,432 A | * | 5/1998 | Gwaltney | 399/341 X |
| 5,807,461 A | | 9/1998 | Hagstrom | |
| 5,842,099 A | * | 11/1998 | Aslam et al. | 399/341 X |
| 5,878,303 A | | 3/1999 | Endo | |
| 6,022,429 A | | 2/2000 | Hagstrom | |
| 6,535,712 B2 | * | 3/2003 | Richards | 399/341 |

* cited by examiner

*Primary Examiner*—William J. Royer

(57) ABSTRACT

An apparatus includes a transfer roller for transferring an image to a print medium, a laminating device to substantially cover the print medium with a laminating powder, and a pressing roller to press and substantially affix the image and the laminating powder to the print medium.

47 Claims, 7 Drawing Sheets

APPARATUS AND METHOD FOR LAMINATING A PRINT MEDIUM IN A PRINTING DEVICE

TECHNICAL FIELD

The present invention relates generally to the field of printing devices. More particularly, the present invention relates to an apparatus and method for laminating a print medium in a printer.

BACKGROUND OF THE INVENTION

Laser printers, copiers, and other similar printing devices mainly include: a photosensitive drum, a developing roller, and a transfer roller or corona wires. In general, in such printing devices, an image is created on the photosensitive drum and then transferred to a sheet of print medium. As used herein, and in the appended claims, the terms "printing device" or "printer" will be understood to refer to all such devices that output a hardcopy document based on the transfer of an image to a sheet of print medium.

FIG. 1 demonstrates a typical laser-printing device. In a typical printing device, a charging device or corona wire 112 uniformly applies an electrical charge to the outer peripheral surface of a photosensitive drum 120. A laser-generating unit 114 modulates a laser beam 110 based on data defining the image to be printed. The modulated laser beam 110 is then scanned across the outer peripheral surface of the photosensitive drum 120. As a result, a corresponding electrostatic latent image is formed on the surface of the photosensitive drum 120 in the charge pattern.

A developing roller 116 conveys, on its surface, toner that is electrically charged to the same polarity as that of the charge on the photosensitive drum 120. Consequently, the photosensitive drum 120 repels the toner, except where the latent image has been written into the charges on the photosensitive drum 120. The electrostatic latent image on the photosensitive drum 120 is thus developed into a visible toner image by the toner supplied from the developing roller 116.

The developed visible image is then transferred from the photosensitive drum 120 onto a sheet of paper, or other print medium, passing between the photosensitive drum 120 and a transfer roller 122. The transfer roller 122 or corona wires (not shown) transfer a static charge to each sheet of print medium. This charge, in turn, attracts the toner from the photosensitive drum 120 to the print medium causing the image to be transferred to the print medium under pressure from the transfer roller 122.

Once the visible image is on the print medium, the print medium passes through a designated transport path 124 to a fuser 111. When the print medium reaches the fuser 111, it heats the print medium causing the toner to partially melt and stick to the print medium forming a substantially permanent bond.

A number of common applications also call for a protective sheet to cover the printed medium in order to protect the printed medium as well as strengthen and prolong medium life. Traditionally, lamination has served this purpose. A traditional method for laminating a printed medium calls for the printed medium to be removed from the location of the printer and transported to an external laminating device. Once at the lamination device, a pair of lamination sheet members are placed over the printed medium, top and bottom, and pressed at relatively high temperatures to hermetically seal the printed medium.

While traditional methods of laminating printed medium are effective in protecting the printed medium, a number of disadvantages are inherent in traditional methods. Traditional methods require a separate machine to perform the lamination. The use of an extra machine increases the overall cost of the process as well as consumes valuable space. Moreover, the traditional method of laminating requires the additional steps of transporting the printed medium to the laminating device, placing the medium between the lamination sheet members and placing the medium in the laminating device to receive an application of heat and pressure. These additional steps increase both process time and labor.

Efforts have been made to address the shortcomings of traditional laminating methods as demonstrated by U.S. Pat. No. 5,878,303 issued to Endo and by U.S. Pat. Nos. 5,807,461 and 6,022,429 issued to Hagstrom. These efforts have focused on incorporating the use of conventional lamination sheet members in the printing process. FIG. 2 illustrates the current state of the art. Similar to traditional laser printers, a toner-based image is transferred from a photosensitive drum 220 to a print medium. Once the image is transferred to the print medium by a transfer roller 222, laminate sheet members 234 are used to hermetically seal the print medium. In order to surround the print medium, a laminate sheet transport system 230 is implemented immediately after the transfer roller 222. The laminate sheet transport system 230 is made of a transport web 232 which supplies the lamination sheet members 234 to surround the print medium, introduces the print medium between the lamination sheet members 234, and transports the surrounded print medium to a fuser 211 where the lamination sheet members 234 are sealed to the print medium.

While the above-mentioned solutions do allow both printing and lamination of print medium in a single machine, the process sacrifices space by greatly increasing the overall size of the printing device. Additionally, the process increases the complexity of the printing machines by having to address the regulation of the bias voltage of the transfer roller 222 to prevent residual toner located on the photosensitive drum 220 and the transfer roller 222 from transferring onto and marking the lamination sheet members 234.

SUMMARY OF THE INVENTION

In one of many possible embodiments of the present invention, a printing apparatus includes a transfer roller for transferring an image to a print medium, a laminating device for substantially covering the print medium with a laminating powder, and a pressing roller to press the print medium after receipt of the image and the laminating powder in order to substantially affix the image and the laminating powder to the print medium.

BRIEF DESCRIPTION OF THE DRAWINGS

The accompanying drawings illustrate embodiments of the present invention and are a part of the specification. Together with the following description, the drawings demonstrate and explain the principles of the present invention. The illustrated embodiments are examples of the present invention and do not limit the scope of the invention. Like reference numerals refer to similar, though not necessarily identical, elements in the figures of the accompanying drawings.

DETAILED DESCRIPTION

Embodiments of the invention are generally drawn to an apparatus for creating laminated output directly from a printing device. According to one example implementation, described more fully below, an innovative printing device is presented that outputs laminated documents. In the following description, for purposes of explanation, numerous specific details are set forth in order to provide a thorough understanding of the invention. It will be apparent, however, to one skilled in the art that the invention can be practiced without these specific details.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Exemplary Overall Structure

Figure 1:
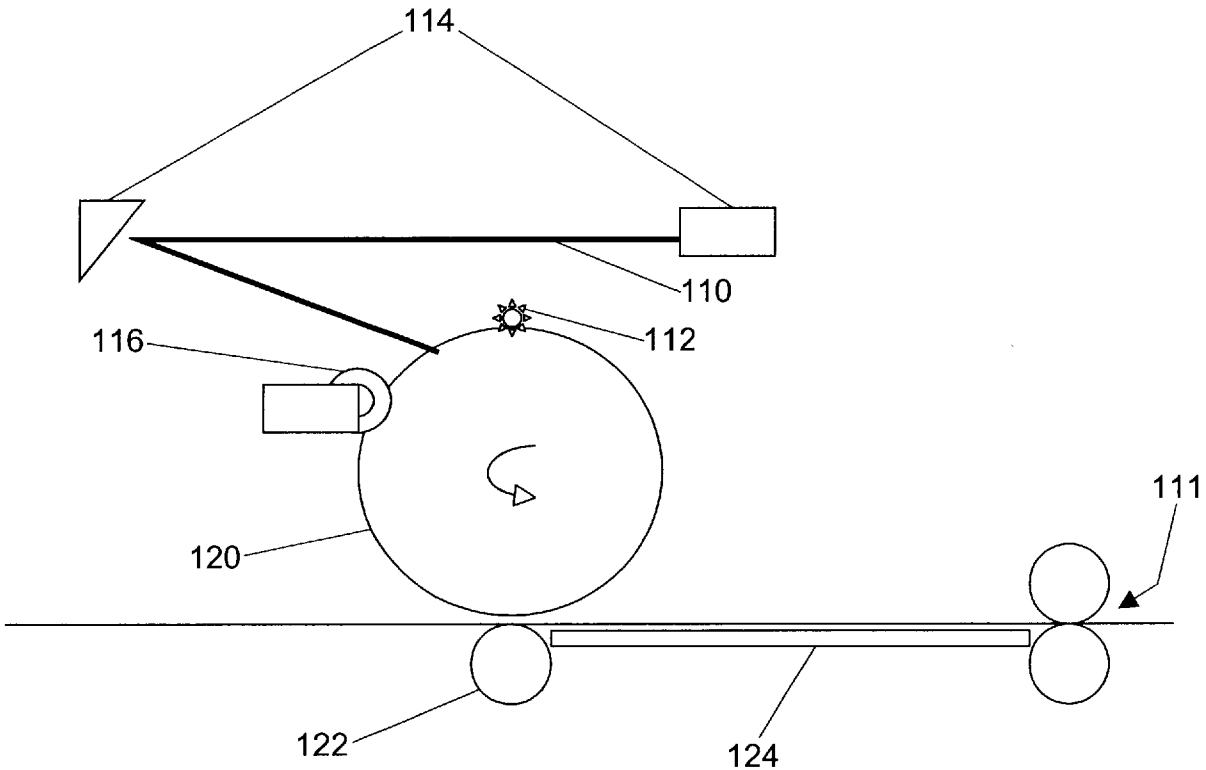
Fig. 1 Prior Art
FIG. 1 shows a perspective view of a prior art laser printer design.
Figure 2:
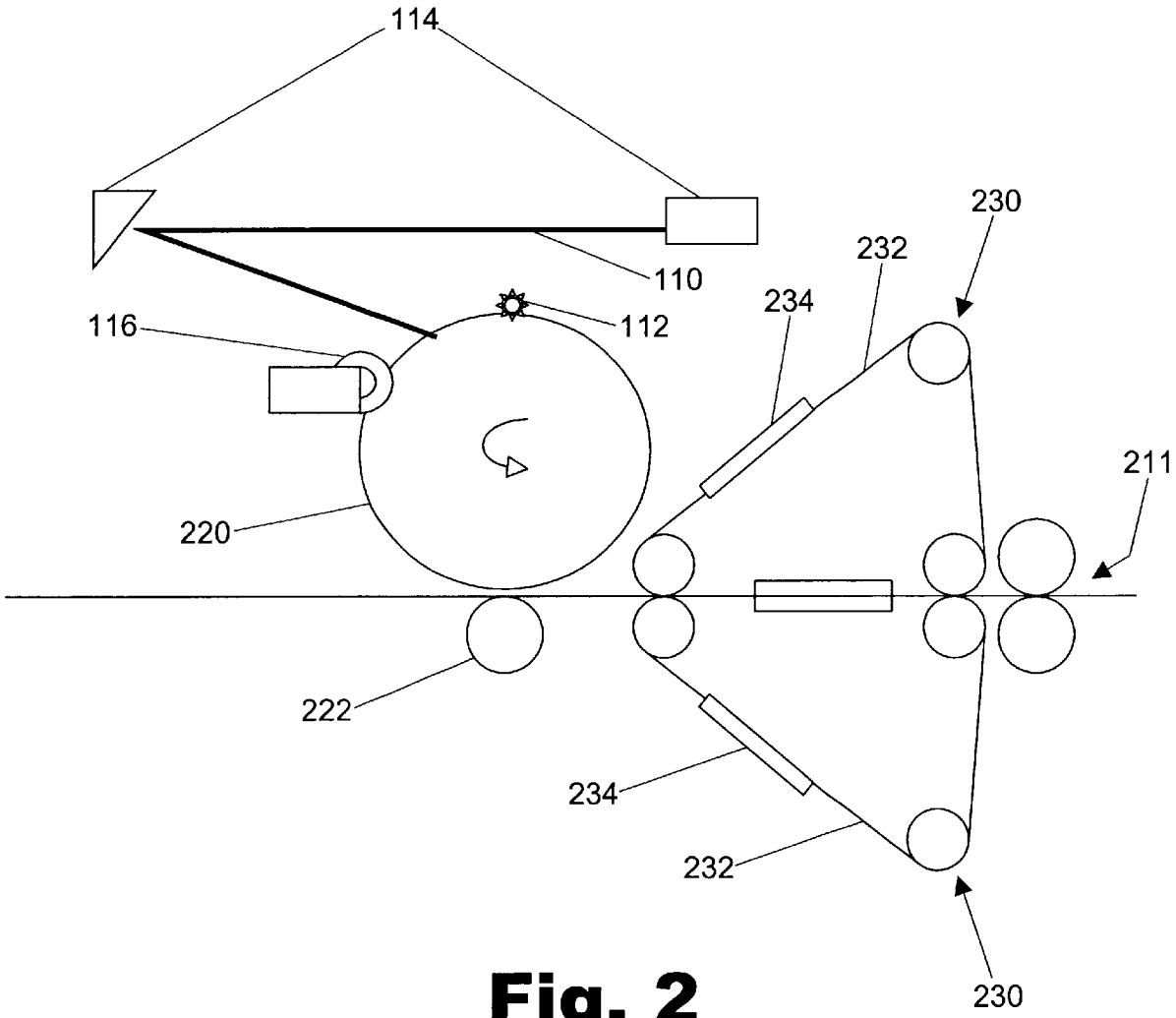
Fig. 2 Prior Art
FIG. 2 illustrates a perspective view of a prior art laser printer design that includes the use of laminating sheet members.
Figure 3:
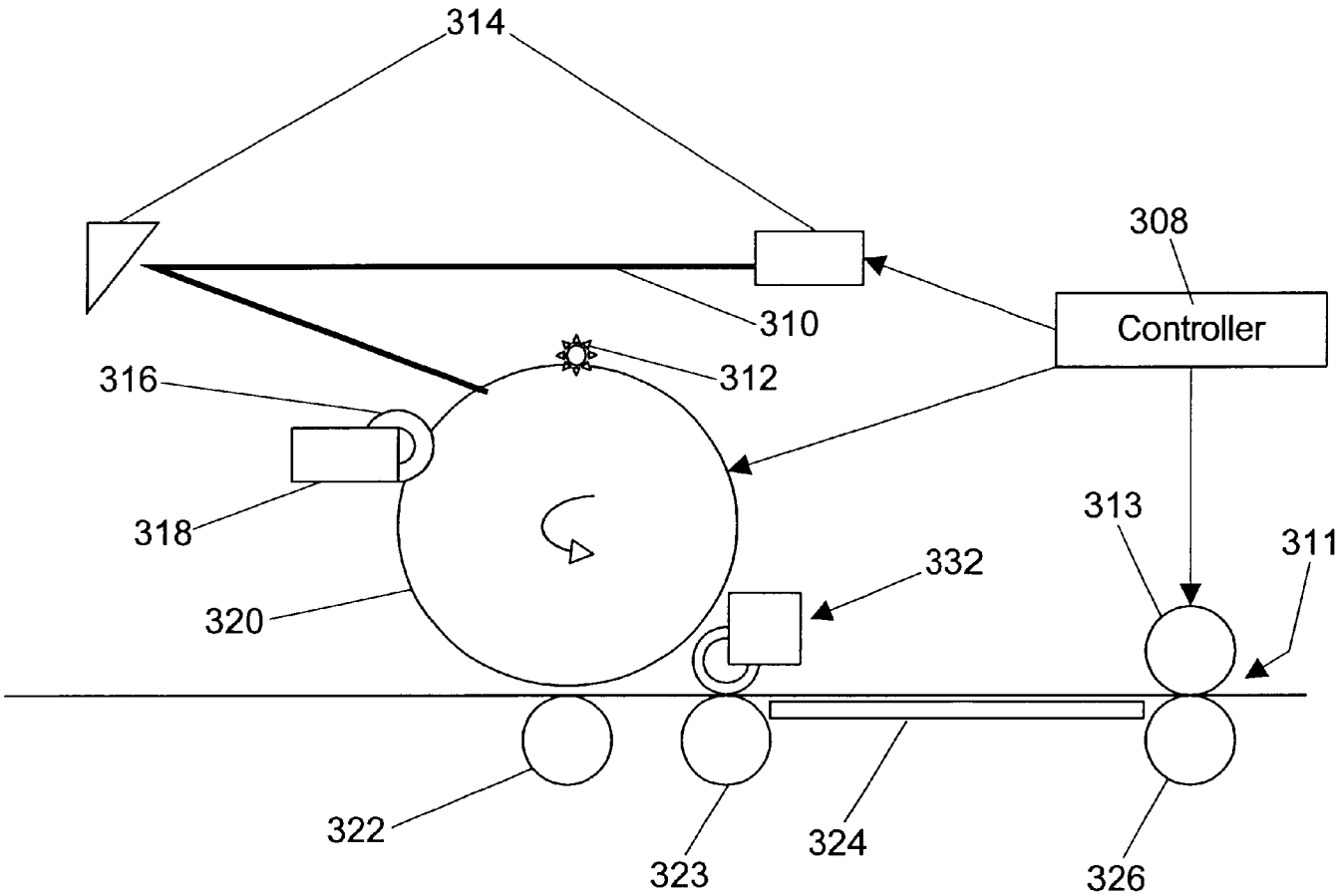
FIG. 3 demonstrates a printing device according to an embodiment of the present invention.

FIG. 3 illustrates an embodiment of a printing device according to principles of the present invention. As shown in FIG. 3, such a printing device preferably includes a corona wire 312 in substantially close proximity to a photosensitive drum 320. A laser-scanning unit 314, a developer roller 316, a toner supply 318, and a transfer roller 322 are also located adjacent to the photosensitive drum 320. Some of these components are located in or along a print medium transport path 324. Moving along the direction of the transport path 324, immediately after the transfer roller 322 is a laminate applicator 332 and a laminate transfer roller 323. Subsequent to the laminate transfer roller 323 the transport path 324 for print media extends to a fuser 311. FIG. 3 also illustrates a controller 308 communicatively coupled to the laser-scanning unit 314, the photosensitive drum 320, and the fuser 311. Throughout the operation of the present invention, the controller 308 controls the function of the laser-scanning unit 314, the photosensitive drum 320, and the fuser 311.

The laminate applicator 332 preferably applies a laminating powder to the printed sheet of print media. When exposed to the heat of the fuser 311, the laminating powder melts into a clear layer of lamination that covers and seals the printed sheet. Preferably, the laminating powder is a polarized polymer powder that melts and substantially bonds with the print medium when heated.

Figure 5:
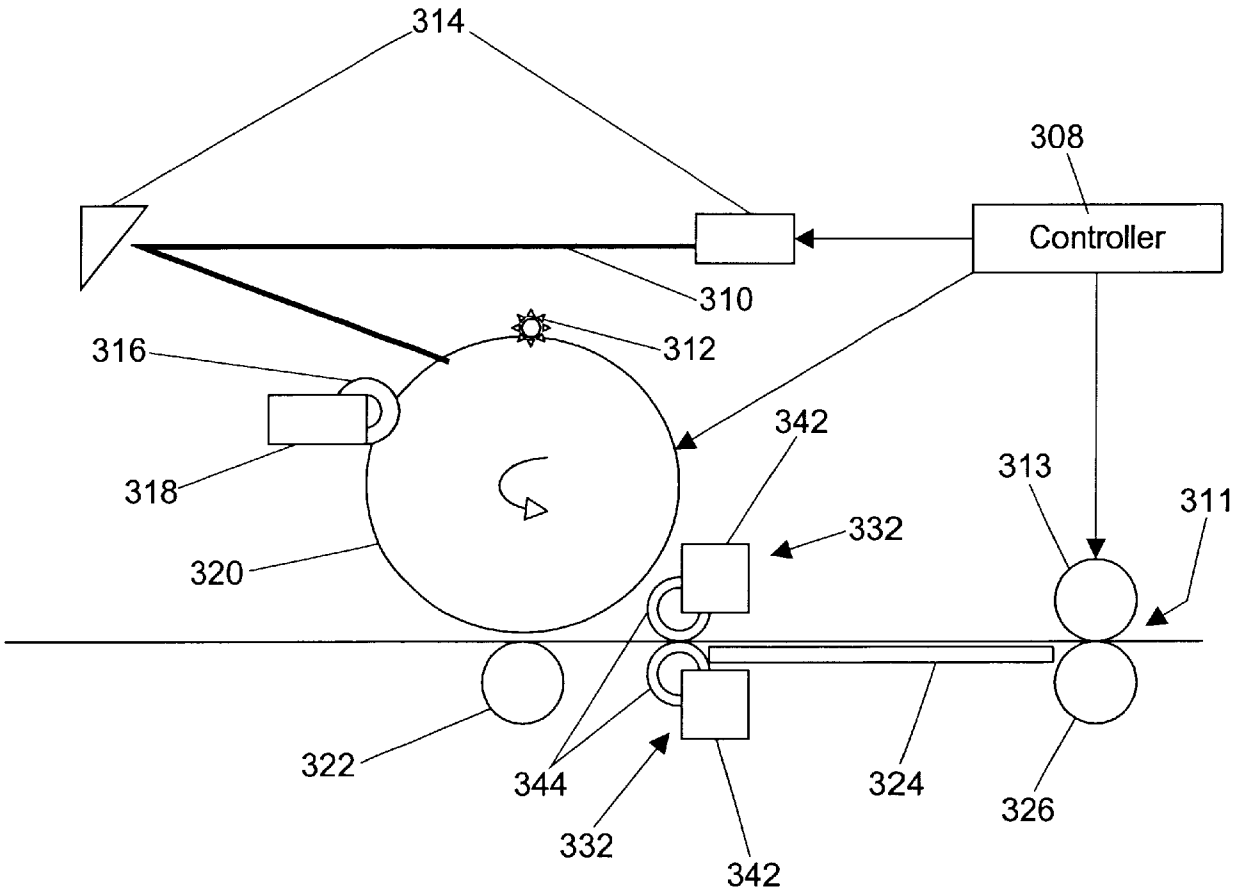
FIG. 5 demonstrates an alternative embodiment of a printing device according to principles of the present invention.
Figure 6:
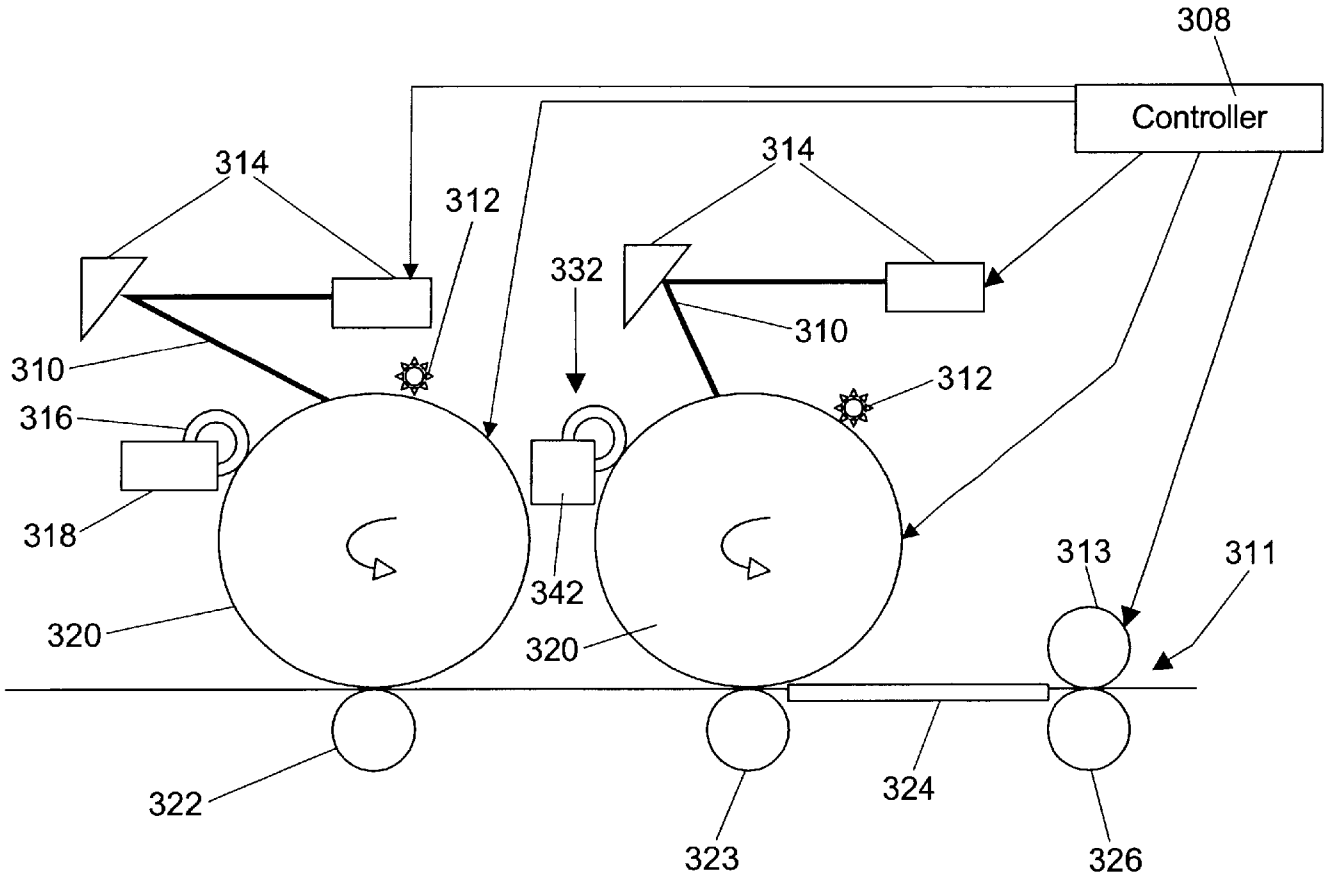
FIG. 6 demonstrates an alternative embodiment of a printing device according to principles of the present invention.

Alternative embodiments of the present invention are also demonstrated in FIGS. 5 and 6. FIG. 5 demonstrates an alternative embodiment of the present invention that incorporates two laminate applicators 332 with the laminator rollers 344 coupled. FIG. 6 illustrates an embodiment of a printing device that selectively applies laminating powder to a print medium. As shown in FIG. 6, the printing device preferably includes two photosensitive drums 320: one in communication with a toner supply 318 and developer roller 316, and one in communication with a laminate applicator 332 and a laminate powder reservoir 342. In the embodiment illustrated in FIG. 6, each photosensitive drum 320 is also in communication with a transfer roller 322, 323 and a corona wire 312. A transport path 324 is located after the second photosensitive drum 320, which leads to a fuser 311.

Exemplary Implementation and Operation

Implementation and operation will be explained primarily using FIGS. 3 and 4. When printing an image, the photosensitive drum 320 is rotated in the direction indicated by the arrow in the figure (i.e. counterclockwise). First, the charging roller or corona wire 312 uniformly charges the surface of the photosensitive drum 320. This charge is dissipated from the surface of the photosensitive drum 31 when exposed to light. Next, the laser beam 310 from a laser-scanning unit 314 selectively irradiates the surface of the photosensitive drum 320 to form an electrostatic latent image in the charges on the surface of the photosensitive drum 320.

The laser beam 310 is modulated by a laser driver of the laser-scanning unit 314 in accordance with image data that is provided to the printing device to be printed. The controller 308 controls the laser-scanning unit 314, modulating the laser-scanning unit 314 according to image data. Consequently, as the laser beam 310 is scanned across the surface of the photosensitive drum 320 and modulated according to the image data, the image is written in latent form into the charges on the surface of the photosensitive drum 320.

A developing device is provided with the photosensitive drum 320 and includes a developer roller 316 and a toner supply 318. A developing bias voltage is applied to the developer roller 316 from a power supply (not shown). This bias voltage charges the toner that is carried on the developer roller 316. The charge imparted to the toner is of the same polarity as the charge applied on the surface of the photosensitive drum 320 by the charging roller or corona wire 312. Consequently, the charged toner adheres to the electrostatic latent image formed on the surface of the photosensitive drum 320 from which the like charge has been dissipated and is repelled by other portions of the photosensitive drum 320 where a like charge remains. In this way, the image is formed on the photosensitive drum 320 with toner.

With the rotation of the photosensitive drum 320, charged toner is adhered to the entire latent image on the surface of the photosensitive drum 320 by the developer roller 316. This fully develops the latent image on the photosensitive drum 320. Further, with the rotation of the photosensitive drum 320, sheets of print media from a supply of print media (not shown) are sequentially delivered sheet by sheet to impinge upon and stop at a pair of resist rollers (not shown). The paired resist rollers are rotated at a timing so adjusted to make a leading edge of a sheet of print medium register with the image on the photosensitive drum 320. The print medium is guided by a part of the outer surface of a cartridge and delivered to a transfer nip between the photosensitive drum 320 and the transfer roller 322.

As the print medium passes between the photosensitive drum 320 and the transfer roller 322, the print medium is charged to at least 1000V to efficiently transfer the toner of the developed image to the print medium (e.g., paper) and to hold the toner onto the print medium until it is fused. A toner image on the photosensitive drum 320 is then transferred to the print medium by the transfer roller 322.

Figure 4:
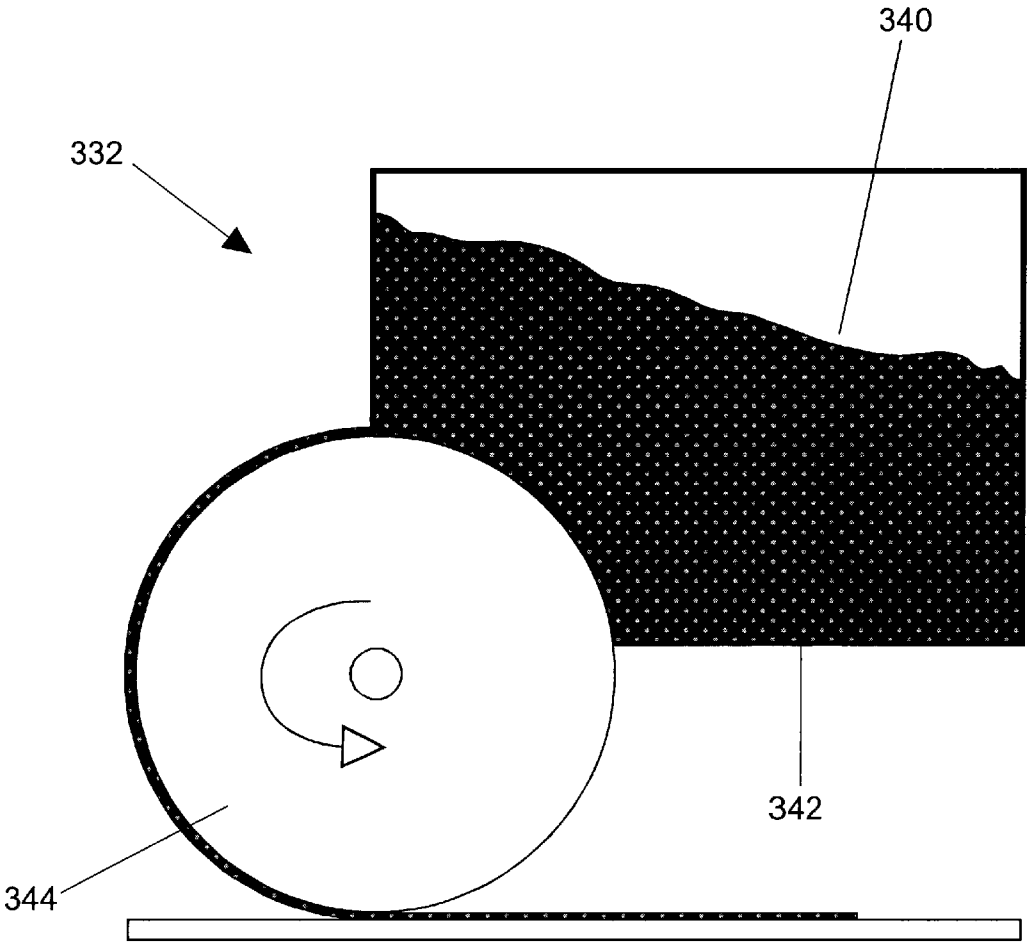
FIG. 4 illustrates a perspective view of a laminating device according to an embodiment of the present invention.

FIG. 4 demonstrates how the laminate powder 340 is transferred from the laminate applicator 332 to the print medium. As the laminator roller 344 rotates, as indicated by the arrow, the outer edge of the laminator roller 344 passes through the laminate powder reservoir 342 receiving a substantially consistent layer of laminate powder 340. As the laminator roller 344 continues to rotate, it comes into contact with the print medium where the layer of laminate powder 340 is transferred from the outer edge of the laminator roller 344 onto the print medium.

After receiving the image transferred from the photosensitive drum 320, the print medium is conveyed to a transfer nip between the laminate transfer roller 323 and the laminate applicator 332. As the print medium passes between the laminate transfer roller 323 and the laminate applicator 332, laminate powder is transferred to the print medium.

Once substantially coated with laminate powder 340, the print medium is transported through a transport path 324 to a fuser 311. The fuser 311 includes a fixing nip disposed between a fixing roller 313 and a pressing roller 326. Once at the fuser 311, heat and pressure are applied to the print medium to substantially fix the toner and the laminate powder 340 on the print medium by partially melting them. Thereafter, the print medium is discharged from the printing device.

Figure 7:
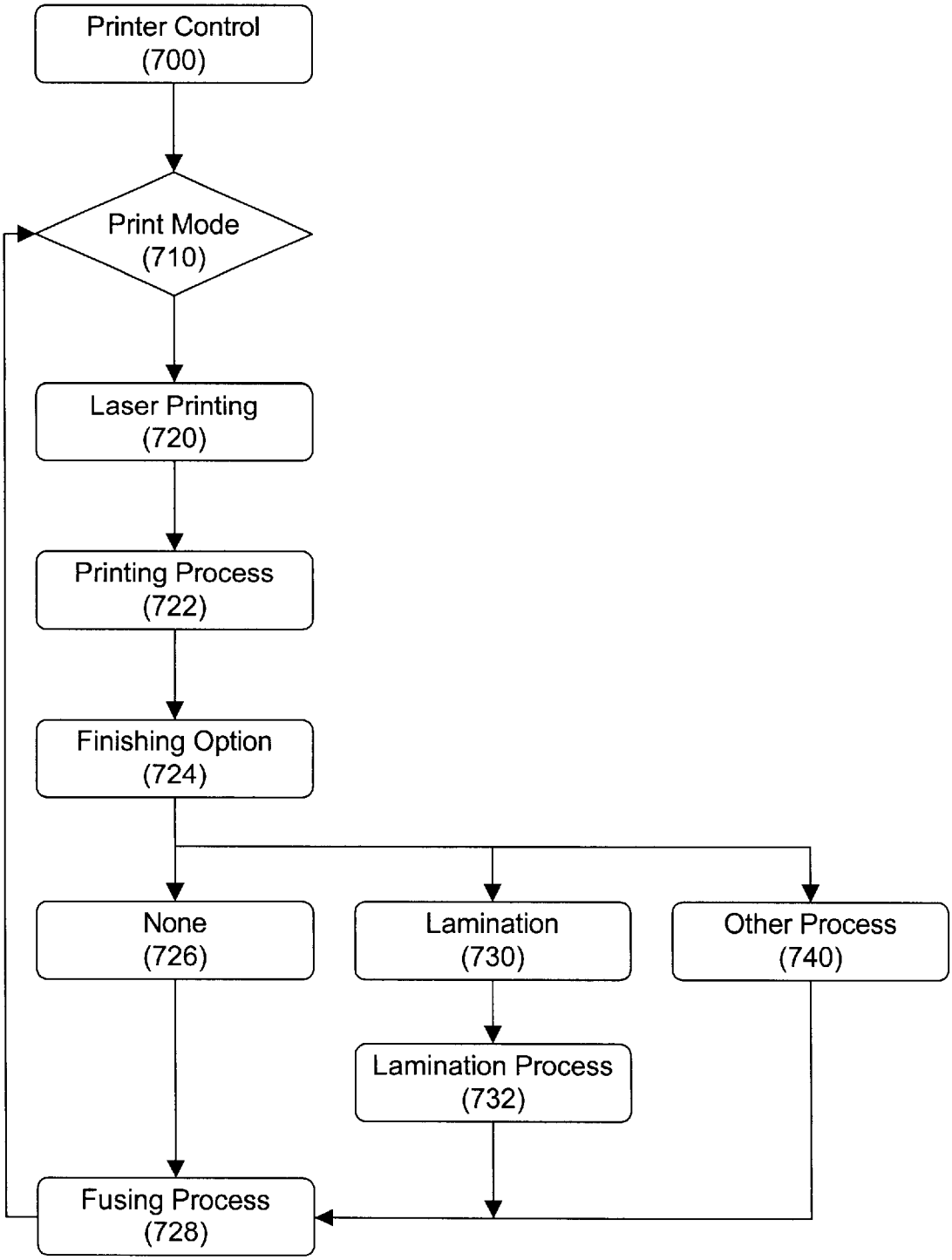
FIG. 7 demonstrates a printer control executed in a control unit according to an embodiment of the present invention.

FIG. 7 demonstrates a printer control executed in the controller 108. According to one embodiment, the printer driver associated with the present invention is loaded on a computing device and includes a finishing option for laminating. The printer control 700 initializes the print mode 710. Once laser printing 720 is selected, the user of the computing device is able to both select the printing process 722 and choose from a number of finishing options 724 including none 726 and lamination 730. If no finishing option is selected, the print medium receives a laser printed toner image as disclosed above and continues on to the fusing process 728 so that the image may be affixed to the print medium. However, if the lamination 730 or other process or finishing option 740 is selected, the lamination process 732 is performed after receiving the toner image but prior to sending the print medium to the fusing process 728.

The present design eliminates the problem of requiring multiple steps in order to print and laminate a print medium by incorporating both steps in one printing device. Under principles of the present invention, the laminate applicator 332 takes a form similar to that of a toner cartridge. The proposed embodiment of the laminate applicator 332 eliminates the need for additional space to house a laminating machine, reduces the cost of manufacture, and improves time required to complete a print/lamination job.

Alternative Embodiments

Alternative embodiments of the claimed invention can be seen in FIGS. 5 and 6. FIG. 5 depicts a perspective view of an alternative embodiment of a printing device in which two laminate applicators 332 are employed according to principles of the present invention. In this embodiment, the laminate powder 340 may coat both sides of the print medium prior to entering the fuser 311. It will be appreciated by one of ordinary skill in the art that any number of laminate applicators 332 may be used without varying from the teachings of the present invention. Additionally, any number of print medium fusers may be employed to affix the toner and laminating powder to the print medium. These fusers may include, but are not limited to: infrared heaters, a xenon flash lamp, or other heat treatments.

Alternatively, FIG. 6 demonstrates an embodiment of the present invention that allows selective lamination of the print medium. As illustrated in FIG. 6, an additional laser beam 310 modulated by a laser driver of a laser-scanning unit 314 scans a second photosensitive drum 320. As the laser beam 310 is scanned across the surface of the photosensitive drum 320 and modulated according to supplied image data, the laminate image is written in latent form into the charges on the surface of the photosensitive drum 320. As the photosensitive drum 320 rotates, it comes into contact with a laminate applicator 332 containing laminate powder 340 of the same polarity as the charge applied on the surface of the photosensitive drum 320 by a charging roller or corona wire 312. Consequently, the charged laminate powder 340 adheres to the electrostatic latent image formed on the surface of the photosensitive drum 320 from which the like charge has been dissipated and is repelled by other portions of the photosensitive drum 320 where a like charge remains. In this way, the selective laminate image is formed on the photosensitive drum 20 with laminate powder 340. With the rotation of the photosensitive drum 320, charged laminate powder 340 is transported from the surface of the photosensitive drum 320 to the print medium. The print medium then continues onward to the transport path 324 and the fuser 311 where the toner and laminate powder 340 are substantially fused to the print medium.

In conclusion, the present invention, in its various embodiments, enables a user to create laminated output directly from a printing device. By eliminating the need for an additional laminating device the present invention reduces the space needed to perform the desired operation, reduces cost, and reduces processing time.

Under principles of the present invention, a cartridge may be provided for the printing/laminating devices described herein. Such a cartridge may include a supply of toner as well as a supply of laminating powder. Alternatively, separate cartridges of toner and laminating powder may be provided within the printer.

The preceding description has been presented only to illustrate and describe the invention. It is not intended to be exhaustive or to limit the invention to any precise form disclosed. Many modifications and variations are possible in light of the above teaching. It is intended that the scope of the invention be defined by the following claims.

What is claimed is:

1. A printing device comprising:

a drum on which an image to be printed is formed;

a developer roller to develop the image on the drum;

a transfer roller to transfer the image from the drum to the print medium;

a laminating device, separate from said drum, configured to cover at least a portion of the sheet of print medium with a laminating powder after said image is transferred to said print medium; and a fuser to press and substantially affix the image and the laminating powder to the print medium.

2. A printing device according to claim 1, wherein the laminating device further comprises a cartridge including a reservoir of laminating powder, and a roller that is partially immersed in the laminating powder to transfer the laminating powder from the reservoir to the print medium.

3. A printing device according to claim 2, wherein the cartridge is replaceable.

4. A printing device according to claim 1, wherein the printing device further comprises a laser printer.

5. A printing device according to claim 1, wherein the printing device further comprises a copy machine.

6. A printing device according to claim 1, wherein the laminating powder comprises a polarized polymer powder that melts and substantially bonds with the print medium to form a laminated layer when heated.

7. A printing device according to claim 6, wherein said fuser further comprises a pressing roller.

8. A printing device according to claim 7, further comprising a charging device to charge the drum.

9. A printing device according to claim 8, further comprising a modulated laser system to write the image to the drum.

10. An apparatus comprising:

a transfer roller for transferring an image to a print medium;

a laminating device to cover at least a portion of the print medium with a laminating powder, said laminating device comprising a reservoir of laminating powder and a roller that is partially immersed in the laminating powder to transfer the laminating powder from the reservoir directly to the print medium; and a pressing roller to press and substantially affix the image and the laminating powder to the print medium.

11. An apparatus according to claim 10, wherein the laminating device is formed in a replaceable cartridge.

12. An apparatus according to claim 10, wherein the pressing roller is heated.

13. An apparatus according to claim 12, wherein the apparatus further comprises a fuser that includes the pressing roller.

14. An apparatus according to claim 10, wherein the laminating powder further comprises a polarized polymer powder that melts and substantially bonds to the print medium when heated to form a laminated layer.

15. An apparatus comprising:

a transfer roller for transferring an image to a print medium;

a laminating device to cover at least a portion of the print medium with a laminating powder; and a pressing roller to press and substantially affix the image and the laminating powder to the print medium; and further comprising a second laminating device, wherein said laminating device and said second laminating device together substantially cover both sides of the print medium with the laminating powder.

16. An apparatus according to claim 15, further comprising a fuser including said pressing roller to heat said laminating powder on said print medium.

17. An apparatus according to claim 16, wherein the laminating powder comprises a polarized polymer powder that melts and substantially bonds to the print medium when heated to form a laminated layer.

18. An apparatus according to claim 15, wherein said laminating device provides said laminating powder directly to said print medium.

19. A printing device comprising:

transfer means for transferring a toner based image to a print medium;

laminating means for applying a laminating powder to at least a portion of the print medium after the print medium receives the toner based image; and fusing means for substantially fusing the toner based image and the laminating powder to the print medium.

20. A printing device according to claim 19, wherein the transfer means comprise a drum on which an image to be printed is formed, a developer roller to develop the image on the drum with toner, a charging device to electrically charge a sheet of print medium, and a transfer roller to transfer the image from the drum to the print medium.

21. A printing device according to claim 19, wherein the laminating means comprise a cartridge including a reservoir of laminating powder, and a roller that is in communication with the laminating powder to transfer the laminating powder from the reservoir to the print medium.

22. A printing device according to claim 21, wherein the laminating powder comprises a polarized polymer powder that melts and substantially bonds to the print medium when heated to form a laminated layer.

23. A method for creating laminated output directly from a printing device, the method comprising:

applying a toner image to a print medium;

transferring a laminating powder to the print medium, covering at least a portion of the print medium with the laminating powder, wherein transferring a laminating powder onto the print medium further comprises transferring the laminating powder to both sides of the print medium; and substantially adhering the laminating powder and the toner image to the print medium.

24. A method according to claim 23 wherein applying a toner image to a print medium comprises:

forming an image on a photosensitive drum;

applying toner from a developer roller to the photosensitive drum;

charging the print medium; and transferring the toner image from the photosensitive drum to the charged print medium.

25. A method according to claim 23, wherein transferring a laminating powder onto the print medium comprises:

transferring a laminating powder from a reservoir to a roller;

rotating the roller until the laminating powder is in contact with the print medium; and transferring the laminating powder onto a surface of the print medium from the roller.

26. A method according to claim 23, wherein adhering the laminating powder and the toner image to the printed medium comprises:

heating the print medium as the print medium passes through a fuser;

applying pressure to the print medium as the print medium passes through the fuser; and partially melting the toner and the laminating powder, causing the laminating powder to stick to the print medium to form a substantially permanent bond.

27. A method of creating laminated output directly from a printing device, the method comprising:

forming a toner image on first photosensitive drum;

transferring said toner image onto a print medium;

selectively transferring a laminating powder onto sections of the print medium; and adhering the laminating powder and the toner image to the print medium;

wherein selectively transferring a laminating powder onto the print medium comprises:

forming a latent image on a second photosensitive drum;

applying a laminating powder from a developer roller to the second photosensitive drum in accordance with the latent image; and transferring the laminating powder from the developer roller to the print medium.

28. A method according to claim 27, wherein forming a toner image comprises:

forming an image on the first photosensitive drum; and applying toner from a developer roller to the first photosensitive drum to form the toner image.

29. A method according to claim 27, wherein transferring the toner image onto the print medium comprises:

charging the print medium: and transferring the toner image from the first photosensitive drum to the charged print medium.

30. A method according to claim 27, wherein adhering the laminating powder and the toner image to the print medium comprises:

heating the print medium as the print medium passes through a fuser;

applying pressure to the print medium as the print medium passes through the fuser; and partially melting the toner and the laminating powder to adhere the toner and laminating powder to the print medium to form a substantially permanent bond.

31. A storage medium comprising executable content comprising a printer driver, which when executed by a computing device, causes the computing device to control a printing device connected to the computing device to:

apply a toner image on a print medium;

selectively transfer a laminating powder onto the print medium, covering at least a portion of the print medium; and adhere the laminating powder and the toner image to the printed medium by heating and applying pressure to the toner image and laminating powder;

wherein said printer driver comprises a user interface allowing a user to control said selective transfer of said laminating powder from said computing device which is controlling said printing device.

32. A storage medium according to claim 31, wherein the storage medium resides within a remote server communicatively coupled to and accessible by an executing system.

33. A storage medium according to claim 31, wherein the storage medium further comprises executable content, which when executed by a computing device, includes a user interface that includes a lamination printing option for selection by a user of the computing device.

34. A method of producing a laminated output from a printing device, said method comprising:

transferring a toner image to a print medium;

transferring a laminating powder directly to said print medium with a roller that is partially immersed in a supply of the laminating powder; and fixing the toner image and the laminating powder to the print medium.

35. A method according to claim 34, further comprising replacing a cartridge comprising said supply of laminating powder when said supply of laminating powder is exhausted.

36. A method according to claim 34, wherein said fixing comprises heating said laminating powder.

37. A method according to claim 34, wherein said transferring a laminating powder comprises applying laminating powder to both sides of said print medium.

38. An apparatus comprising:

a transfer roller for transferring an image to a print medium;

a laminating means for covering at least a portion of both sides of the print medium with a laminating powder; and fixing means for substantially affixing the image and the laminating powder to the print medium.

39. An apparatus according to claim 38, wherein the laminating powder comprises a polarized polymer powder that melts and substantially bonds to the print medium when heated to form a laminated layer.

40. An apparatus according to claim 38, wherein said laminating means provide said laminating powder directly to said print medium.

41. A printing and laminating device comprising:

a first photosensitive drum configured to receive a toner image and transfer said toner image to a print medium;

a developer roller for developing said toner image on said first photosensitive drum;

a second photosensitive drum; and a laminating device for applying laminating powder to a latent image formed on said second photosensitive drum.

42. A device according to claim 41, wherein said latent image developed with laminating powder is transferred to said print medium.

43. A device according to claim 41, further comprising a fixing apparatus for fixing the laminating powder and the toner image to the print medium.

44. A printing and laminating device comprising:

means for forming a toner image;

means for transferring said toner image to a print medium;

means for forming a second image with laminating powder; and means for transferring said second image to said print medium.

45. A device according to claim 44, wherein said means for forming a toner image comprise a photosensitive drum and a developer roller.

46. A device according to claim 44, wherein said means for forming a second image comprise a photosensitive drum and a laminating roller depositing said laminating powder over a latent image formed on said photosensitive drum.

47. A device according to claim 44, further comprising means for fixing the laminating powder and the toner image to the print medium.

* * * * *

UNITED STATES PATENT AND TRADEMARK OFFICE

CERTIFICATE OF CORRECTION

PATENT NO. : 6,751,436 B2
DATED : June 15, 2004
INVENTOR(S) : Bhatti et al.

It is certified that error appears in the above-identified patent and that said Letters Patent is hereby corrected as shown below:

Column 5,
Line 3, insert the following paragraph:

-- After receiving the image transferred from the photosensitive drum 320, the print medium is conveyed to a transfer nip between the laminate transfer roller 323 and the laminate applicator 332. As the print medium passes between the laminate transfer roller 323 and the laminate applicator 332, laminate powder is transferred to the print medium. --

Column 9,
Line 14, delete "medium:" and insert therefor -- medium; --

Signed and Sealed this

Twenty-sixth Day of April, 2005

JON W. DUDAS
*Director of the United States Patent and Trademark Office*